US006421850B1

(12) United States Patent
Welsh, Jr.

(10) Patent No.: US 6,421,850 B1
(45) Date of Patent: Jul. 23, 2002

(54) PLAY YARD HAVING A LOWER FRAME WITH A LOCKING JOINT

(75) Inventor: Thomas J. Welsh, Jr., Aurora, IL (US)

(73) Assignee: Kolcraft Enterprises, Inc., Chicago, IL (US)

( * ) Notice: Subject to any disclaimer, the term of this patent is extended or adjusted under 35 U.S.C. 154(b) by 0 days.

(21) Appl. No.: 09/518,831

(22) Filed: Mar. 6, 2000

(51) Int. Cl.[7] ..... A47D 7/00

(52) U.S. Cl. ..... 5/99.1; 5/98.1

(58) Field of Search ..... 5/99.1, 98.1, 93.1

(56) References Cited

U.S. PATENT DOCUMENTS

| | | | | |
|---|---|---|---|---|
| 1,211,730 | A | 1/1917 | Lucas | 5/99.1 |
| 1,413,068 | A | 4/1922 | Stotler et al. | 5/99.1 |
| 2,486,054 | A | 10/1949 | Morse | 5/99 |
| 2,561,637 | A | 7/1951 | Rex | 5/99 |
| 2,617,999 | A | 11/1952 | Mitchell | 5/99 |
| 2,624,054 | A | 1/1953 | Plant | 5/99 |
| 2,659,903 | A | 11/1953 | Hagelfeldt | 5/99 |
| 2,698,443 | A | 1/1955 | Ralick | 5/99 |
| 2,710,976 | A | 6/1955 | Martensen | 5/98 |
| D186,358 | S | 10/1959 | Fulton | D5/5 |
| 2,908,021 | A | 10/1959 | Fulton | 5/99 |
| 2,992,441 | A | 7/1961 | Landry | 5/99 |
| RE25,195 | E | 7/1962 | Hamilton | 5/98 |
| 3,063,065 | A | 11/1962 | Shaw | 5/99 |
| 3,092,847 | A | 6/1963 | De Puy | 5/99 |
| 3,095,583 | A | 7/1963 | Golub et al. | 5/99 |
| 3,309,718 | A | 3/1967 | Sarasin | 5/98 |
| 4,008,499 | A | 2/1977 | Wren, Jr. et al. | 5/99 |
| 4,044,411 | A | 8/1977 | Peterson | 5/99 |
| 4,069,524 | A | 1/1978 | Carlo | 5/99 |
| 4,070,716 | A | 1/1978 | Satt et al. | 5/99 |
| D257,299 | S | 10/1980 | Cone | D6/13 |
| 4,357,735 | A | 11/1982 | Saint et al. | 16/224 |
| 4,483,026 | A | 11/1984 | Kassai | 5/99 |
| 4,499,619 | A | 2/1985 | Kassai | 5/99 |
| 4,561,138 | A | 12/1985 | Hwang | 5/102 |
| 4,599,832 | A | 7/1986 | Benton et al. | 52/118 |
| 4,669,138 | A | 6/1987 | Kassai | 5/99 |
| 4,688,280 | A | 8/1987 | Kohus et al. | 5/99 |
| 4,739,527 | A | 4/1988 | Kohus et al. | 5/99 |
| 4,811,437 | A | 3/1989 | Dillner et al. | 5/99 |
| 4,934,025 | A | 6/1990 | Mariol | 16/347 |
| 4,985,948 | A | 1/1991 | Mariol | 5/99 |
| 5,025,517 | A | 6/1991 | Johnson | 5/99.1 |
| D323,589 | S | 2/1992 | Mariol | D6/331 |
| 5,197,154 | A | 3/1993 | Shamie | 5/99 |
| 5,211,498 | A | 5/1993 | Huang | 403/102 |
| 5,228,154 | A | 7/1993 | Brevi et al. | 5/99 |
| 5,239,714 | A | 8/1993 | Huang | 5/99.1 |
| 5,241,716 | A | 9/1993 | Kohus | 5/99.1 |
| 5,243,718 | A | 9/1993 | Shamie | 5/99.1 |
| 5,279,006 | A | 1/1994 | Teng | 5/99.1 |
| 5,293,656 | A | 3/1994 | Chan | 5/99.1 |
| 5,339,470 | A | 8/1994 | Shamie | 5/98.1 |
| 5,353,451 | A | 10/1994 | Hsiung | 5/98.1 |
| 5,363,521 | A | 11/1994 | Garland et al. | 5/99.1 |
| 5,367,725 | A | 11/1994 | Tsai | 5/99.1 |
| 5,377,368 | A | 1/1995 | Cheng | 5/99.1 |

(List continued on next page.)

FOREIGN PATENT DOCUMENTS

| | | |
|---|---|---|
| FR | 2 361 846 | 3/1978 |

*Primary Examiner*—Alexander Grosz
(74) *Attorney, Agent, or Firm*—Marshall, Gerstein & Borun.

(57) ABSTRACT

A play yard having a foldable lower frame with a locking joint is disclosed. The locking joint includes a latch that prevents the lower frame section containing the joint from folding unless the latch is intentionally released. The latch is biased into the latch position, but can be intentionally released when the play yard is erected or partially erected to complete folding of the play yard. The latch can be released when the play yard is fully erected or partially folded.

51 Claims, 8 Drawing Sheets

U.S. PATENT DOCUMENTS

| | | | | |
|---|---|---|---|---|
| 5,381,570 | A | 1/1995 | Cheng | 5/99.1 |
| 5,446,931 | A | 9/1995 | Wei | 5/98.1 |
| 5,504,951 | A | 4/1996 | Yeh | 5/99.1 |
| 5,542,134 | A | 8/1996 | Wang | 5/99.1 |
| 5,560,055 | A | 10/1996 | Ziegler | 5/99.1 |
| 5,664,267 | A | 9/1997 | Cheng | 5/99.1 |
| 5,745,954 | A | 5/1998 | Shogan et al. | 16/343 |
| 5,781,944 | A | 7/1998 | Huang | 5/99.1 |
| 5,826,285 | A | 10/1998 | Mariol et al. | 5/99.1 |
| 5,857,229 | A | 1/1999 | Magnani, Jr. | 5/99.1 |
| 5,867,851 | A | 2/1999 | Mariol et al. | 5/99.1 |
| D409,411 | S | 5/1999 | Mariol et al. | D6/391 |
| 5,904,344 | A | 5/1999 | Pope et al. | 256/25 |
| 5,911,653 | A * | 6/1999 | Cheng | 5/99.1 |
| D413,025 | S | 8/1999 | Mariol et al. | D6/331 |
| 5,978,987 | A | 11/1999 | Wang | 5/99.1 |

* cited by examiner

PLAY YARD HAVING A LOWER FRAME WITH A LOCKING JOINT

FIELD OF THE INVENTION

The invention relates generally to play yards, and, more particularly, to a play yard having a lower frame with a locking joint.

BACKGROUND OF THE INVENTION

Folding portable play yards have become increasingly popular in recent years. Such play yards typically include an upper frame, a lower frame and fabric sides stretched between the upper and lower frames which, together with a fabric floor stretched across the lower frame, defines an enclosure for an infant or small child. Known play yard typically have three or four sides.

To facilitate storage and transport of the play yard, each side of the upper and lower frames typically includes two rails joined in the middle of the side by a joint of some sort. The joints in the upper frame of these devices are designed with a releasable lock to ensure the upper frame does not inadvertently fold. The joints in the lower frame of known prior art play yards do not include a positive lock, but instead rely on gravity to prevent inadvertent folding of the lower frame.

SUMMARY OF THE INVENTION

In accordance with an aspect of the invention, a foldable play yard is disclosed. The foldable play yard includes an upper frame. It also includes a lower frame which has at least one joint to permit folding of at least a portion of the lower frame. The play yard also includes a floor supported by the lower frame. The at least one joint of the lower frame is displaced from a center of the floor. Additionally, the play yard includes a latch cooperating with the at least one joint to releasably prevent the at least a portion of the lower frame from folding.

In accordance with another aspect of the invention, a locking joint is disclosed for use with a foldable play yard having an upper frame and a lower frame. The locking joint includes a first joint member defining a first opening and a second joint member defining a second opening. The first and second joint members are disposed in the lower frame and are joined for pivoting movement between a first position and a second position. The first and second openings are substantially aligned when the first and second joint members are in the first position. The locking joint also includes a latch dimensioned to mate with the first and second openings to releasably secure the first and second joint members in the first position.

In accordance with yet another aspect of the invention, a foldable play yard is disclosed. The foldable play yard includes a foldable upper frame; a foldable lower frame having a first rail and a second rail; and a hinge joining the first and second rails for movement between an erected position and a folded position. The hinge and the first and second rails are substantially linearly aligned to define a lower edge of the play yard when the first and second rails are in the erected position. The foldable play yard also includes a latch cooperating with the hinge to selectively secure the hinge and the first and second rails in the erected position.

Other features and advantages are inherent in the disclosed apparatus or will become apparent to those of ordinary skill in the art from the following detailed description and its accompanying drawings.

DESCRIPTION OF THE PREFERRED EMBODIMENTS

Figure 1:
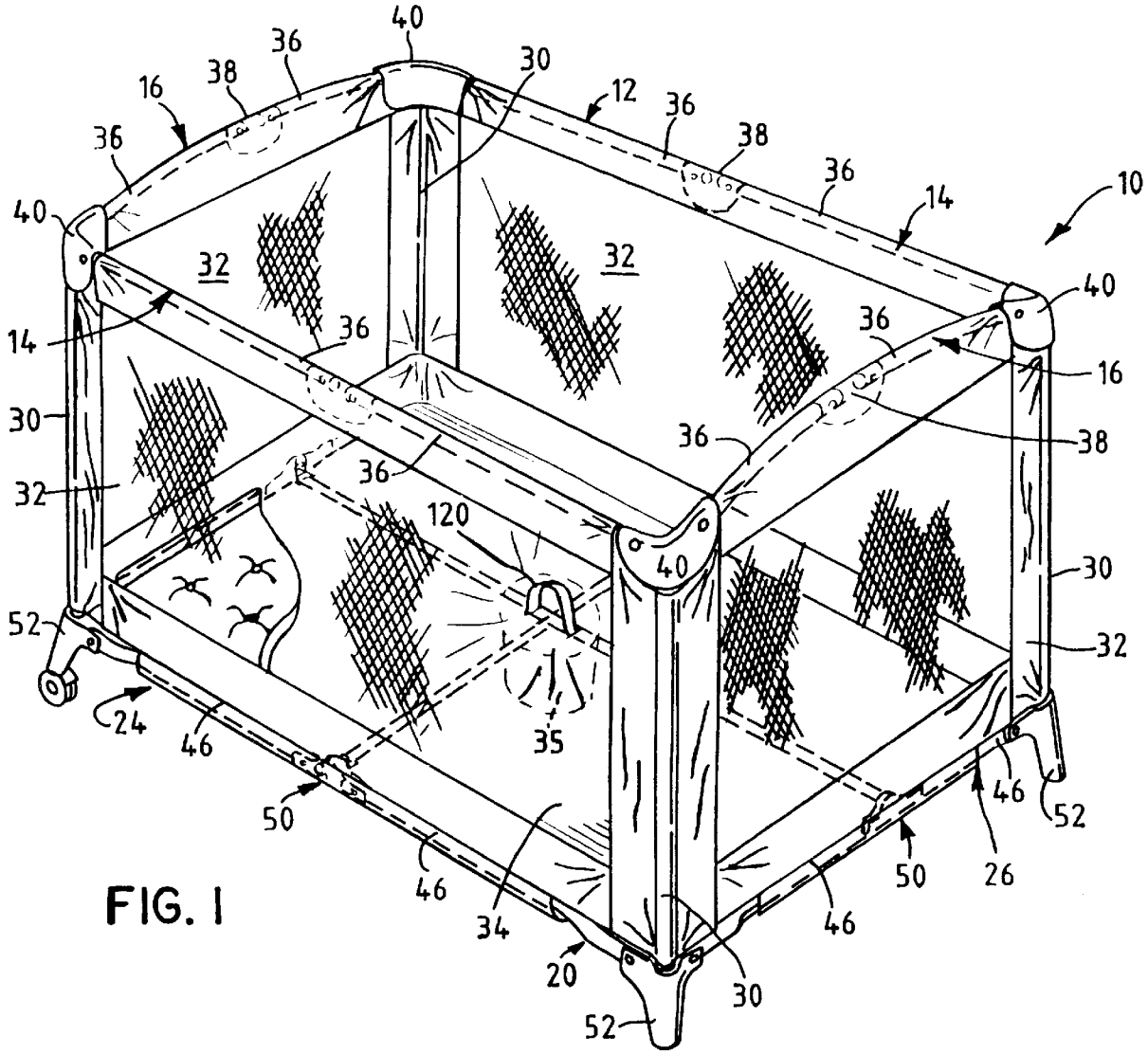
FIG. 1 is a perspective view of a play yard constructed in accordance with the teachings of the instant invention.

A play yard 10 constructed in accordance with the teachings of the invention is shown in FIG. 1. Although for purposes of illustration, a particular play yard is disclosed and described herein, persons of ordinary skill in the art will readily appreciate that the teachings of the invention are not limited to any particular environment of use. On the contrary, the teachings of the invention can be employed with any play yard which would benefit from the enhanced safety it offers. Thus, for example, although the illustrated play yard is a four-sided, rectangular play yard, the teachings of the invention can be used with play yards of any size and shape (e.g., three or more sides) without departing from the scope or spirit of the invention.

The illustrated play yard includes an upper frame 12, a lower frame 20, and four upright posts 30 operatively coupling the upper and lower frames 12, 20. Fabric sides 32 which, in the illustrated play yard, include mesh panels, are secured to the upper and lower frames 12, 20 in a conventional manner. When the play yard 10 is erected, the fabric sides 32 cooperate with a fabric floor 34 to create an enclosure for an infant or small child. To further support the floor 34 when the play yard 10 is erected, the play yard 10 is further provided with a pedestal 35. The pedestal 35 is a cylindrical or conical structure with a flat bottom. It is preferably made of molded plastic and is rigidly coupled to the bottom of the floor 34 near its center by conventional fasteners such as rivets, glue, or the like.

The upper frame 12 of the illustrated play yard includes four sides, namely, two long sides 14 and two short sides 16. Each of the sides 14, 16 of the upper frame 12 comprises two rails 36 which are pivotably coupled by a rail joint 38. The rail joint 38 can be constructed in many different ways without departing from the scope or spirit of the invention. By way of example, not limitation, the rail joint 38 may be implemented by the rail joint disclosed in U.S. patent application Ser. No. 09/161,132, now U.S. Pat. No. 6,250,837, which is hereby incorporated in its entirety by reference.

The ends of the rails 36 opposite the rail joint 38 are pivotably coupled to a plastic comer housing 40. Each of the comer housings 40 are coupled to one of the vertical posts 30 in a conventional manner.

Figure 2:
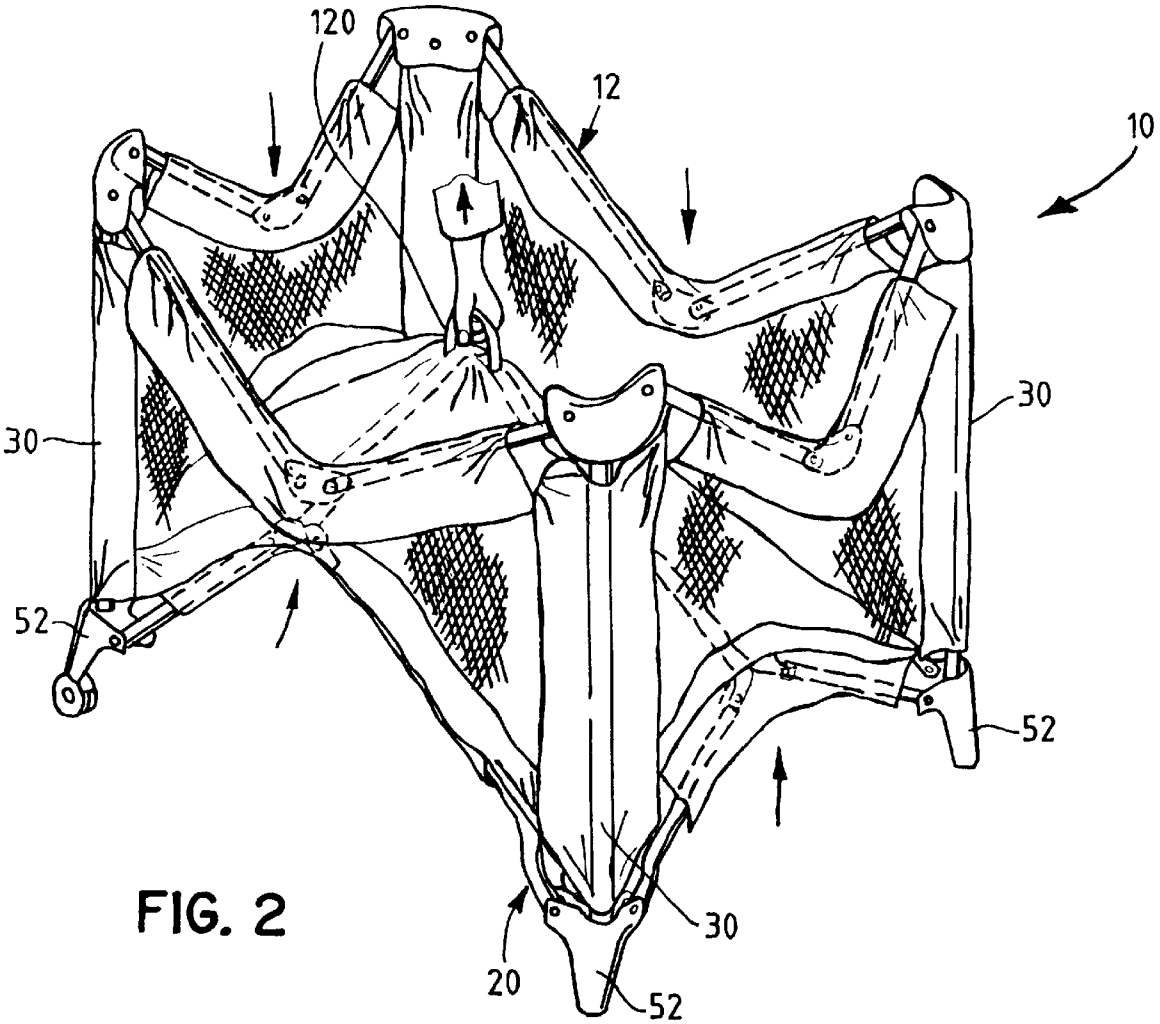
FIG. 2 is a view similar to FIG. 1, but showing the play yard in the process of being collapsed.
Figure 3:
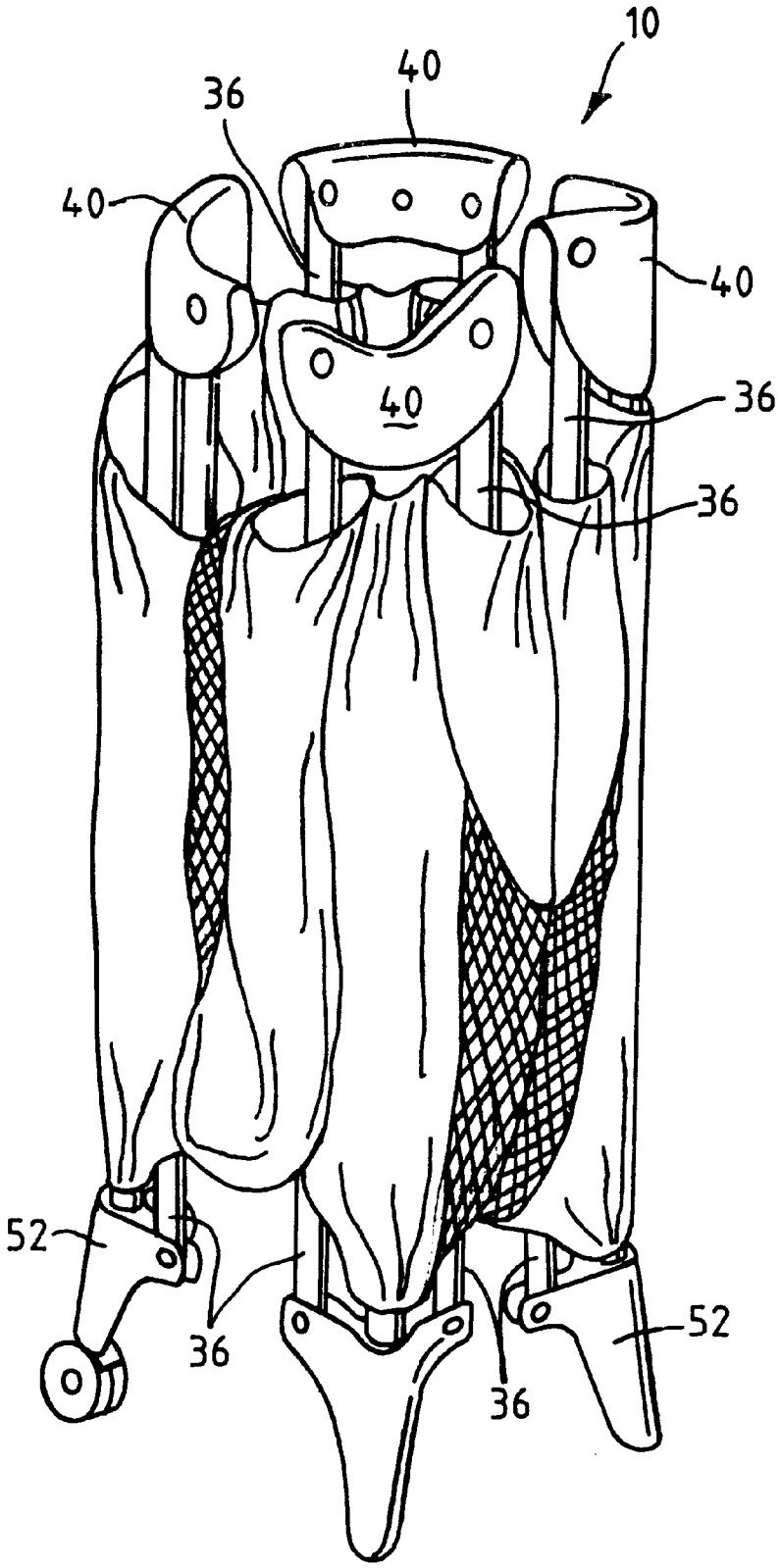
FIG. 3 is a perspective view of the play yard of FIG. 1 in the fully collapsed condition.

Like the upper frame 12, the lower frame 20 of the illustrated play yard 10 includes two long sides 24 and two short sides 26. Also like the upper frame 12, the sides 24, 26 of the lower frame 20 each includes two rails 46 which are coupled by a joint 50. The ends of the rails 46 opposite the joint 50 are pivotally coupled to a support foot 52 in a conventional manner. (In the illustrated play yard, two of the support feet 52 include rollers to facilitate moving the play yard 10.) By manipulating the joints 38, 50 of the upper and lower frames 12, 20 a person can change the state of the play yard 10 between an erected condition such as that shown in FIG. 1 and a folded condition such as that shown in FIG. 3. Various intermediate states of folding are also possible as shown in FIG. 2. When the lower frame 20 is in the erected condition, the rails 46 are substantially linearly aligned with their respective joints 50. Each set of two rails 46 and a joint 50 define a lower edge (i.e., the lower perimeter) of the play yard adjacent the play yard floor when the play yard is erected.

In accordance with an aspect of the invention, the play yard 10 is further provided with a latch 80 cooperating with at least one of the joints 50 of the lower frame 20 to prevent the joint 50 from inadvertently folding. Preferably, each hinge or joint 50 of the lower frame 20 includes a latch 80. Thus, while each hinge 50 is adapted to move with its associated rails 46 between an erected position (for example, the position of FIG. 1) and a folded position (for example, the position of FIG. 2), the latches 80 cooperate with their respective hinges 50 to releasably secure the hinges (and, thus, the connected rails 46) in the erected position.

Figure 7:
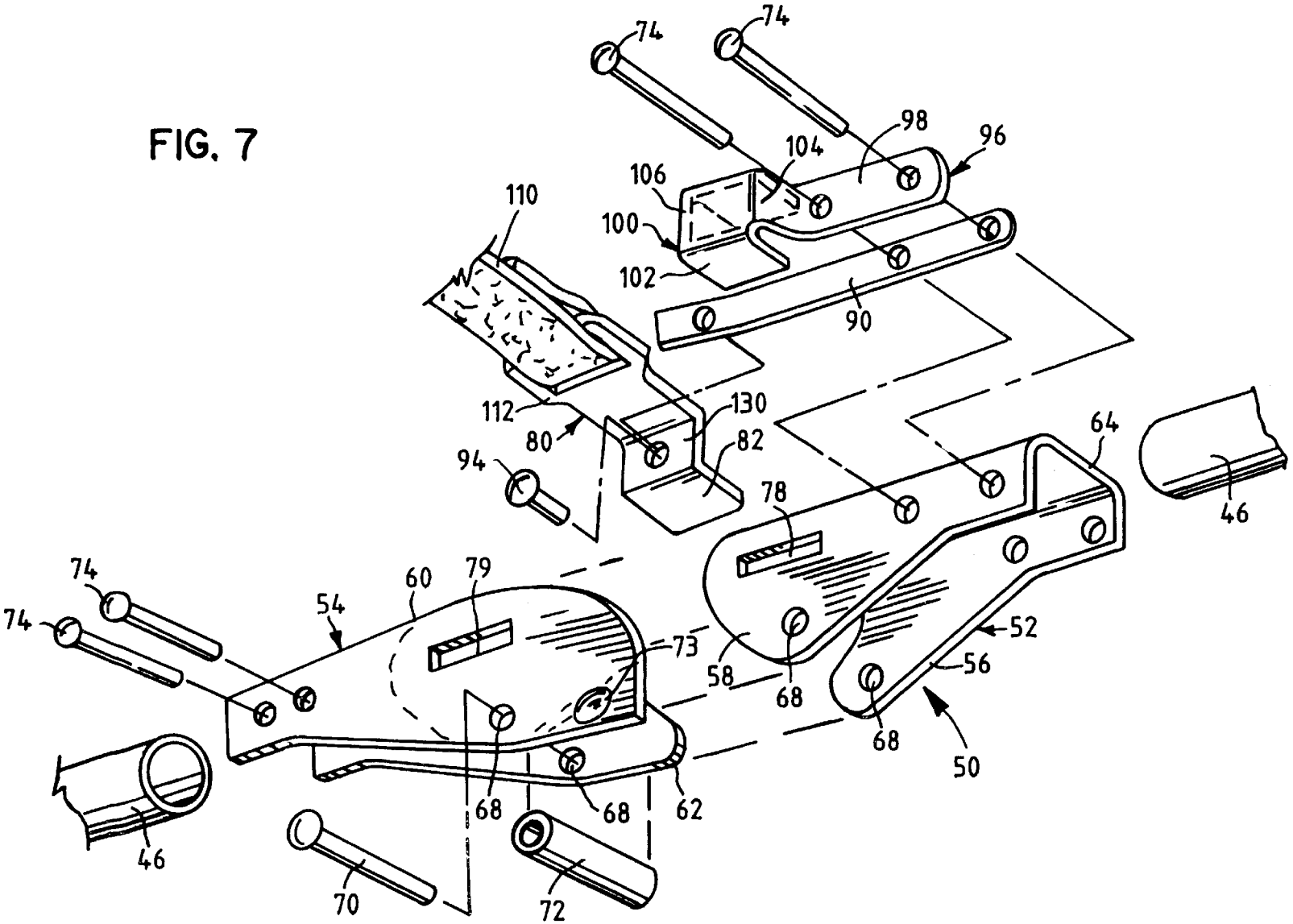
FIG. 7 is an exploded view of the locking joint of FIGS. 5–6.
Figure 8:
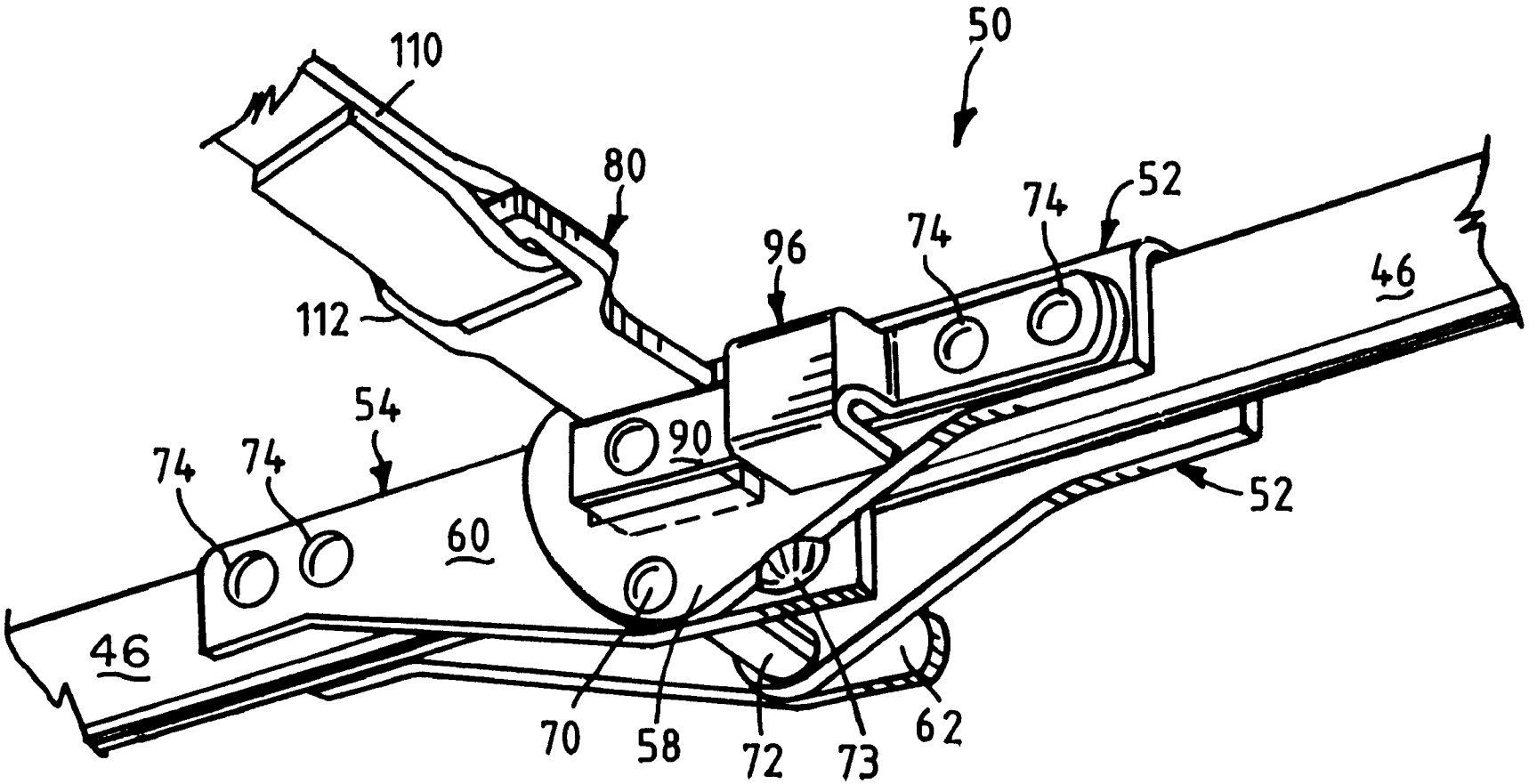
FIG. 8 is a perspective view of the locking joint of FIGS. 5–7.

The preferred locking joint 50 is shown in detail in FIGS. 7 and 8. For the purposes of defining a hinge, the locking joint 50 includes a first joint member 52 and a second joint member 54. Each joint member 52, 54 comprises two flanges 56, 58, 60, 62 and a web 64, 65 joining the flanges 56, 58 or 60, 62. Each of the flanges 56, 58, 60 62 defines a bore 68 which is sized to receive a pivot pin 70. The webs 64, 65 and flanges 56, 58, 60, 62 are constructed such that the joint members 52, 54 can be partially overlapped and the bores 68 aligned go that the pivot pin 70 can join the joint members 52, 54 as shown in FIG. 8 for pivoting motion between the erected and folded positions. The pivot pin 70 is preferably implemented by a conventional fastener such as a rivet.

Figure 5:
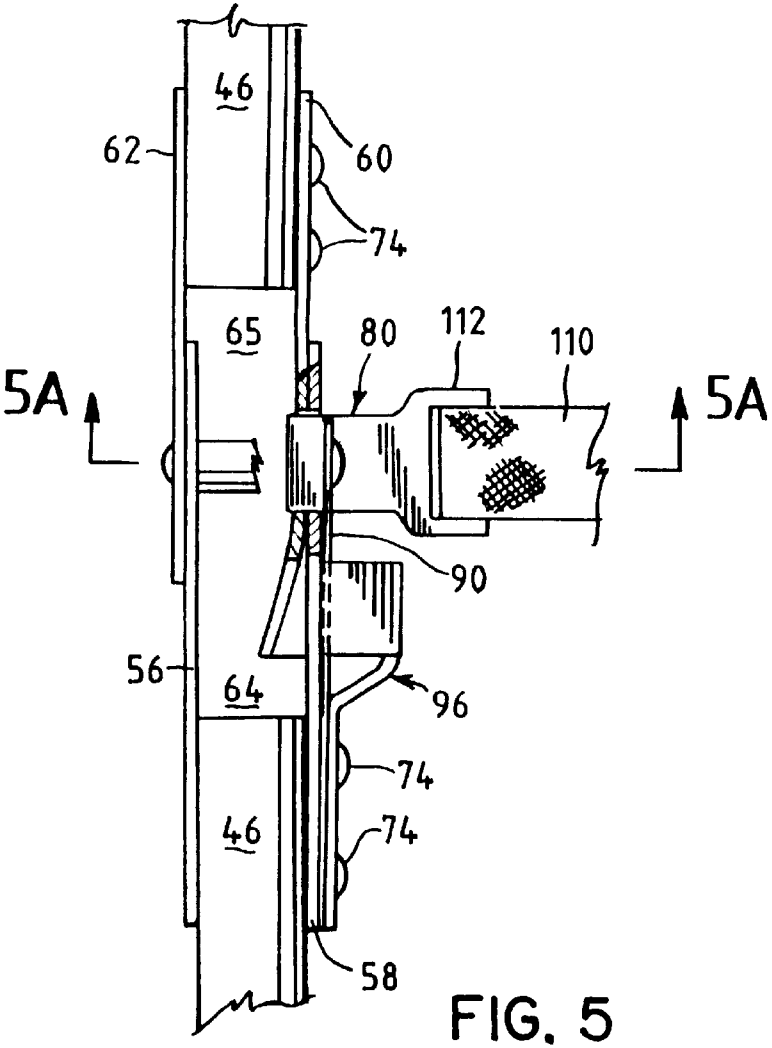
FIG. 5 is a top, partially cut-away view of a locking joint of the play yard of FIG. 1 with the latch in the secured position.

As mentioned above, the rails 46 of the lower frame are preferably rigidly coupled to the joint 50. As most easily seen in FIGS. 5, 6 and 7, this rigid coupling is effected by a pair of rivets 74. Specifically, each pair of rivets 74 penetrates a pair of flanges 56, 58 or 60, 62 of one of the joint members 52, 54 as well as one of the rails 46 located between the flanges 56, 58 or 60, 62.

For the purpose of enhancing the structural rigidity of the joint 50, the joint 50 is further provided with a spacer 72. As shown in FIG. 7, the spacer 72 is preferably implemented by a rigid cylindrical body having a central bore that is sized to receive the pivot pin 70. The cylindrical spacer 72 has a length that permits it to fit between the two innermost flanges 56, 60 of the overlapping joint member 52, 54. The spacer 72 functions to prevent the joint members 52, 54 from collapsing or deforming when subjected to a horizontal load (e.g., when kicked or otherwise struck from the side).

In order to define the erected position of the joint 50 by limiting relative pivoting movement of the joint members 52, 54 relative to one another, the flange 60 of the joint member 54 is provided with a lock protrusion 73. As most easily seen in FIGS. 7 and 8, the lock protrusion 73 is located to engage the flange 58 of the opposite joint member 52 when the joint 50 is in the erected position. The abutment of the lock protrusion 73 and the flange 58 provides a support structure that ensures the load on top of the joint 50 is not carried by the latch 80.

In order to releasably secure the joint members 52, 54 in the erected position, the joint members 52, 54 are provided with openings 78, 79 and the joint 50 is further provided with the latch 80 mentioned above. More specifically, each joint member 52, 54 has a flange 58, 60 which defines a through-hole or opening 78, 79. The openings 78, 79 are positioned in their respective flanges 58, 60 such that, when the joint members 52, 54 are in their erected position, the openings 78, 79 are substantially aligned. In any other position of the joint members 52, 54, the openings 78, 79 are not aligned and at least a portion of the flange 60 is positioned behind the opening 78 of the joint member 52 to thereby prevent the latch 80 from entering the opening 79.

The latch 80 and the openings 78, 79 are sized to cooperate when the joint members 52, 54 are in the erected state to thereby prevent the lower frame 20 from inadvertently folding. In particular, the latch 80 includes a tab 82 which is dimensioned to mate with the openings 78, 79 when the joint 50 is in the erected state. When the tab 82 is simultaneously positioned in the openings 78, 79, it creates an interference that prevents the joint members 52, 54 from pivoting relative to one another. As a result, the joint 50 is secured in the erected position and the joint 50 can only be folded by first withdrawing the tab 82 of the latch 80 from the openings 78, 79.

To bias the latch 80 into mating engagement with the openings 78, 79, the joint 50 is further provided with a spring 90. As shown in FIG. 7, the spring 90 is preferably implemented by spring steel having a first end which is rigidly coupled to the joint member 52 by the rivets 74 and a second end which is rigidly coupled to the latch 80 by a fastener 94 such as a rivet. The spring 90 and the latch 80 are arranged such that the spring 90 biases the latch 80 into engagement with the openings 78, 79 when the openings 78, 79 are aligned.

For the purpose of preventing overloading and overbending of the spring 90 as well as to guide the movement of the spring 90 and the latch 80, the joint 50 is further provided with a spring cover 96. As shown in FIG. 7, the spring cover 96 includes a generally flat flange 9 8 and a cup portion 100. The flange 98 is rigidly secured adjacent and against the spring 90 by the fasteners 74. Thus, the cover 96, like the spring 90, is mounted to, and moves with, the joint member 52.

The cup portion 100 is located at an end of the cover 96 opposite the flange 98. The cup portion 100 includes a lower flange 102, an upper flange 104 and a web 106 joining the upper and lower flanges 102, 104. The web 106 separates the flanges 102, 104 by a distance sufficient to receive the spring 90 therebetween, preferably without frictional engagement between the spring 90 and the flanges 102, 104. The flanges 102, 104 have a length selected to permit bending of the spring 90 to a degree sufficient to permit withdrawal of the tab 82 from the openings 78, 79, but insufficient to overbend the spring 90 . In other words, contact between the web 104 of the cover 96 and the spring 90 limits the degree of bending to which the spring 90 can be subjected to thereby prevent damage to the spring 90.

As mentioned above, the lower frame 20 preferably includes a locking joint 50 in each side of the play yard 10.

Figure 4:
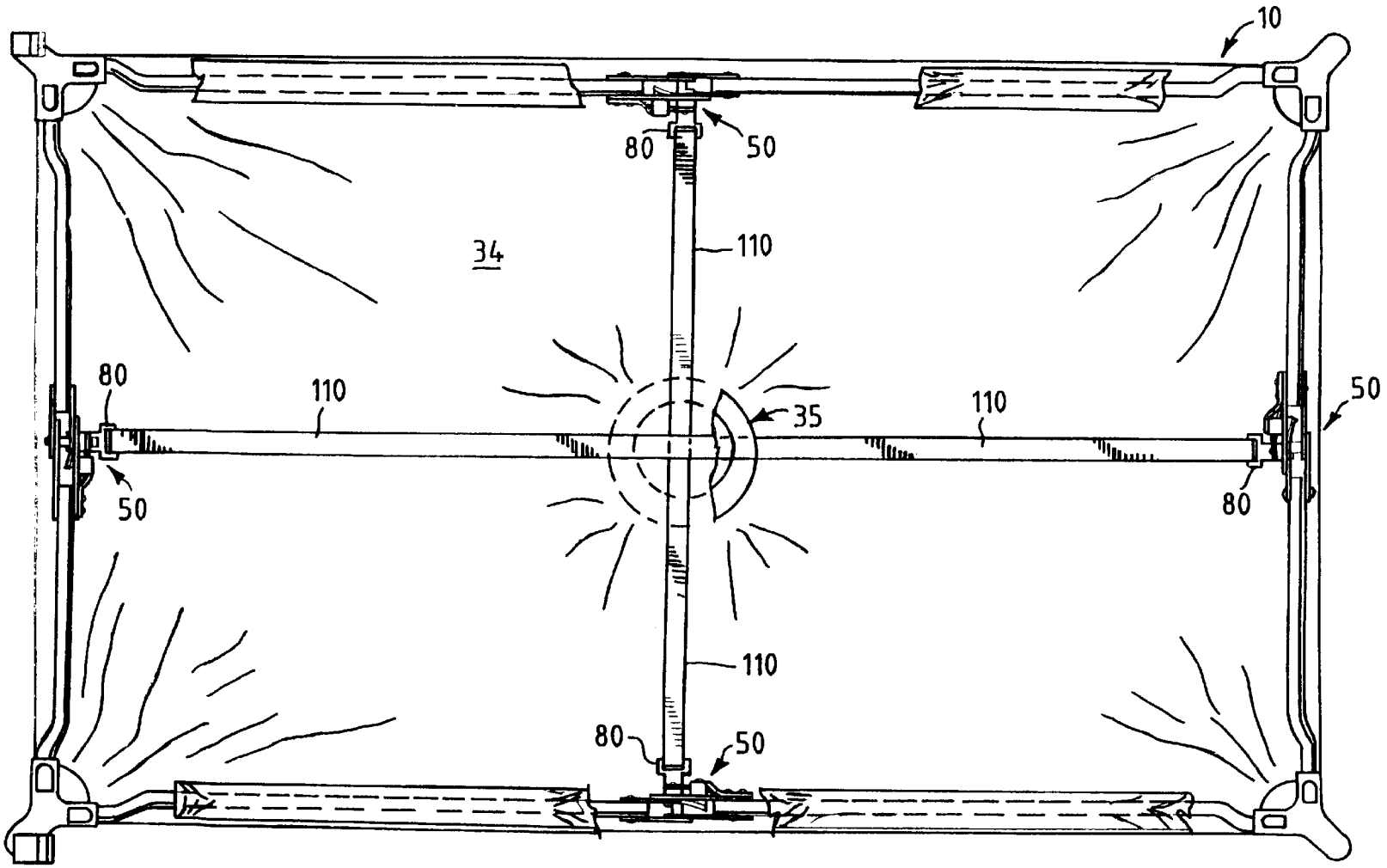
FIG. 4 is a bottom view of the play yard of FIG. 1 with some of the fabric removed for purposes of illustration.

Thus, in the illustrated play yard 10, there are four locking joints 50. In order to selectively release the latches 80 from the openings 78, 79 of their respective joint members 52, 54 to release the joints 50 for folding, the play yard 10 is preferably provided with a plurality of straps 110. As most easily seen in FIG. 4, the straps 110 are preferably sewn or otherwise secured to an undersurface of the center of the floor 34 adjacent and above the pedestal 35. The opposite end of each strap 110 is coupled to a respective one of the latches 80.

More specifically, as most easily seen in FIGS. 7 and 8, each latch 80 includes a flange 112. The flange 112 defines an opening through which the strap 110 is looped. As shown in FIGS. 7 and 8, the strap 110 is sewn or otherwise fastened upon itself to ensure the strap 110 and latch 80 remain connected.

Figure 6:
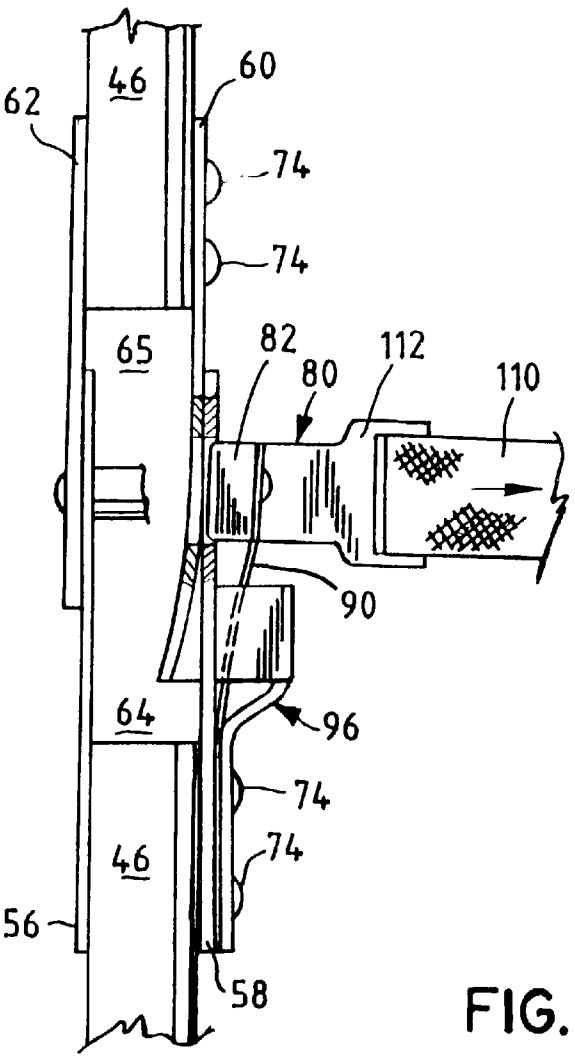
FIG. 6 is a view similar to FIG. 5, but showing the latch in the released position.

To enable substantially simultaneous release of all of the latches 80 from their respective joint members 52, 54, the play yard 10 is further provided with a handle 120. As shown in FIGS. 1 and 2, the handle 120 is secured to the floor 34 adjacent the center thereof. Since the straps 110 are also secured to the floor 34 near the center of the floor 34, the handle 120 and straps 110 are operatively coupled through the floor 34. As a result, if a user lifts the handle 120 as shown in FIG. 2, the straps 110 will be pulled inwardly and upwardly. The inward movement of the straps 110 causes an inward movement of their respective latches 80. If the movement is sufficient, the latches 80 will be pulled out of the corresponding openings 79 against the force of their respective springs 90 as shown in FIG. 6. With the latches 80 so withdrawn, the hinge members 52, 54 of the lower frame 20 can be pivoted relative to one another to fold the play yard 10. If, on the other hand, the straps 110 are released with the joint members 52, 54 in the erected position, the latches 80 will move back into their respective openings 79 under the influence of the springs 90 to again lock the joints 50. The cooperation of the covers 96 and the springs 90 ensures the tabs 82 of the latches 80 remain aligned with their respective openings 78, 79.

Persons of ordinary skill in the art will readily appreciate that, to release the joint 50 for pivoting motion, the latch 80 need only be moved a distance sufficient to remove the tab 82 from the opening 79 as shown in FIG. 6. Thus, the cover 96 can be dimensioned to ensure that the tab 82 never fully exits the opening 78 to ensure the latch 80 always remains aligned with opening 78 without departing from the scope or spirit of the invention.

Figure 5B:
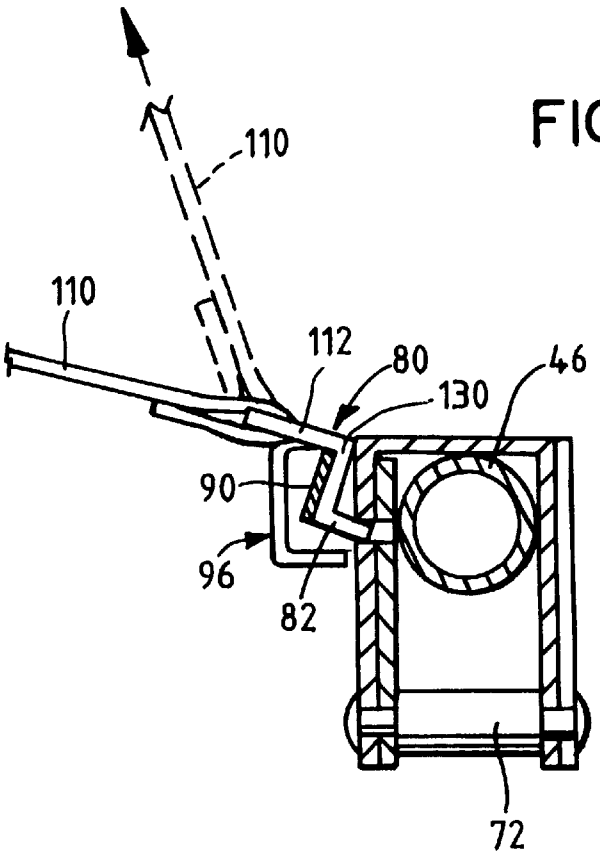
FIG. 5B is a view similar to FIG. 5A, but showing the latch in a released position.

Preferably, the latches 80 are structured such that they may be withdrawn from their respective openings 78, 79 when the play yard 10 is in the fully erected condition and when the play yard 10 is in a partially erected condition. For example, during a folding operation it may happen from time to time that one or more of the joints 50 will be locked while others are released. If this occurs, the strap(s) 110 associated with the locked joints 50 will be disposed at an upwardly inclined angle because the user will have lifted the center of the floor 34 to initiate the folding operation of the lower frame 20 (see, for example, the strap 110 shown in dotted lines in FIG. 5B). Therefore, whereas when all of the joints 50 are locked and a folding operation is initiated, the strap 110 will be pulled inward with a large horizontal component of force (see, for example, the strap 110 shown in solid lines in FIG. 5A), if a joint 50 remains locked while the others are folded, further force applied to the strap 110 associated in the locked joint will have a large vertical component and a small horizontal component (see, for example, the strap 110 shown in dotted lines in FIG. 5A). Therefore, the latches 80 are preferably structured, and the springs 90 are preferably dimensioned, such that the latches 80 will release from their respective openings 79 even in the presence of a relatively small horizontal force component applied by the strap 110.

Conversely, because the straps 110 are secured to an undersurface of the play yard floor 34, when a child is positioned in the play yard a downward force will be applied to the straps 110. As a result, the latches 80 are preferably structured, and the springs 90 are preferably dimensioned, such that the latches 80 will not release in the presence of a downward force below a threshold level.

Figure 5A:
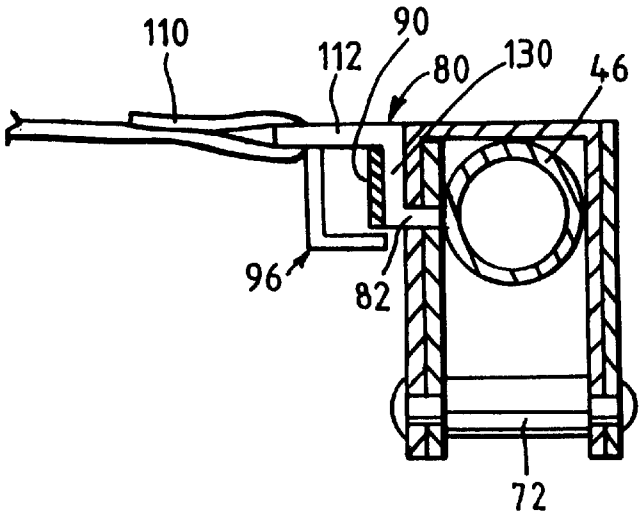
FIG. 5A is a partial cross-sectional view of the locking joint with the latch in the latched position.

More specifically, the latches 80 are preferably structured such that their flange 112 and tab 82 are disposed in different planes (see FIG. 5A). The flange 112 and tab 82 are joined by a web 130. As shown in FIG. 5A, the flange 112 and tab 82 are preferably disposed in substantially parallel planes and the web 130 is preferably positioned in a plane which is substantially perpendicular to both the flange 112 and the tab 82. The springs 90 bias the webs 130 of their respective latches 80 into engagement with the flanges 58 of the joint 50. As a result of this geometry, when a generally upward force is applied to the latch 80 (for example, by the strap 110 shown in dotted lines in FIG. 5B), the upper front face of the web 130 forms a bearing surface against the flange 58 and the latch 80 will rotate in a clockwise direction to rotate the tab 82 out of the opening 79 (see FIG. 5B). On the other hand, there is no bearing surface to promote counterclockwise rotation of the latch 80 when a downward force is applied to the latch 80.

As shown in FIG. 7, the webs 130 of the latches 80 define bores for receiving the fasteners 94. The web 130 is preferably located between the spring 90 and the joint member 52.

Persons of ordinary skill in the art will appreciate that, in the disclosed locking joint 50, the latch 80 actually functions to block movement of the joint members 52, 54 in only one direction in FIG. 7, since the interaction of the flange 58 of the joint member 52 and the lock protrusion 73 of the joint member 54 prevents further downward pivoting when the openings 78, 79 are aligned to receive the latch 80. As a result, although the openings 78, 79 are shown to be enclosed on all sides, they could be open to the top without departing from the scope or spirit of the invention. Persons of ordinary skill in the art will also appreciate that the latches 80 could alternatively be used to block movement in both directions without departing from the scope or spirit of the invention.

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. A foldable play yard comprising:

an upper frame;

a lower frame including at least one joint to permit folding of at least a portion of the lower frame;

a floor supported by the lower frame, the at least one joint of the lower frame being displaced from a center of the floor;

a latch cooperating with the at least one joint to releasably prevent the at least the portion of the lower frame from folding;

a spring biasing the latch into engagement with the at least one joint; and a strap operatively coupled to the latch for selectively moving the latch to permit folding of at least the portion of the lower frame.

2. A play yard as defined in claim 1 further comprising a plurality of posts operatively coupling the upper and lower frames.

3. A play yard as defined in claim 1 wherein the joint further comprises:

a first joint member defining a first opening; and a second joint member defining a second opening, the first and second joint members being joined for pivoting movement between a first position and a second position, the first and second openings being substantially aligned when the first and second joint members are in the first position, and the first and second openings being sized to cooperate with the latch to releasably secure the first and second joint members in the first position to prevent the at least a portion of the lower frame from folding.

4. A play yard as defined in claim 3 wherein the first joint member comprises a first flange, a second flange, and a web joining the first and second flanges, and the second joint member comprises a third flange, a fourth flange, and a web joining the third and fourth flanges.

5. A play yard as defined in claim 4 wherein the first, second, third, and fourth flanges define bores for receiving a pivot pin which pivotably joins the first and second joint members.

6. A play yard as defined in claim 4 further comprising a spacer positioned between at least two of the first, second, third, and fourth flanges to increase the structural rigidity of the at least one joint.

7. A play yard as defined in claim 3 further comprising a lock protrusion positioned to engage one of the first and second joint members to define the first position of the first and second joint members.

8. A play yard as defined in claim 3 wherein the at least a portion of the lower frame comprises a first rail and a second rail, the first joint member is operatively coupled to the first rail, and the second joint member is operatively coupled to the second rail.

9. A play yard as defined in claim 1 further comprising a cover located to prevent overloading of the spring.

10. A play yard as defined in claim 9 wherein the spring and the cover are mounted to the at least one joint.

11. A play yard as defined in claim 1 further comprising a handle positioned at a substantially central area of the floor, wherein the strap is operatively coupled to the handle such that, lifting the handle pulls the strap to move the latch to permit folding of at least the portion of the lower frame.

12. A play yard as defined in claim 1 wherein the latch is shaped such that the latch is maneuverable to release the at least one joint to permit the at least a portion of the lower frame to fold when the play yard is in a partially erected condition and also when the play yard is in a fully erected condition.

13. A play yard as defined in claim 12 wherein the latch comprises:

a tab;

a flange; and a web joining the tab and the flange, wherein the tab and the flange are disposed in different planes.

14. A play yard as defined in claim 13 wherein the flange and the tab are disposed in substantially parallel planes.

15. A play yard as defined in claim 14 wherein the flange is disposed above the tab.

16. A play yard as defined in claim 15 wherein the at least one joint includes a first joint member defining a first opening and a second joint member defining a second opening, and wherein the flange and one of the first and second joint members cooperate to rotate the tab out of at least one of the first and second openings in response to a force with an upward component.

17. A foldable play yard comprising:

an upper frame;

a lower frame including at least one joint to permit folding of at least a portion of the lower frame;

a floor supported by the lower frame, the at least one joint of the lower frame being displaced from a center of the floor; and a latch cooperating with the at least one joint to releasably prevent the at least the portion of the lower frame from folding;

wherein the joint further comprises a first joint member defining a first opening; and a second joint member defining a second opening, the first and second joint members being joined for pivoting movement between a first position and a second position, the first and second openings being substantially aligned when the first and second joint members are in the first position, and the first and second openings being sized to cooperate with the latch to releasably secure the first and second joint members in the first position to prevent the at least a portion of the lower frame from folding;

a strap operatively coupled to the latch for selectively withdrawing the latch from the first and second openings to permit folding of at least the portion of the lower frame.

18. A play yard as defined in claim 17 further comprising a handle positioned at a substantially central area of the floor, wherein the strap is operatively coupled to the handle such that, lifting the handle pulls the strap to withdraw the latch from the first and second openings.

19. A play yard as defined in claim 18 wherein the latch is shaped such that the latch may be withdrawn from the first and second openings when the play yard is in a partially erected condition and also when the play yard is in a fully erected condition.

20. A play yard as defined in claim 19 wherein the latch comprises:

a tab for cooperating with the first and second openings;

a flange for cooperating with the strap; and a web joining the tab and the flange, wherein the tab and the flange are disposed in different planes.

21. A play yard as defined in claim 20 wherein the flange and the tab are disposed in substantially parallel planes.

22. A play yard as defined in claim 20 wherein the flange is disposed above the tab.

23. A play yard as defined in claim 22 wherein the flange and one of the first and second joint members cooperate to rotate the tab out of at least one of the first and second openings in response to a force with an upward component.

24. A foldable play yard comprising:

an upper frame;

a lower frame including at least one joint to permit folding of at least a portion of the lower frame;

a floor supported by the lower frame, the at least one joint of the lower frame being displaced from a center of the floor;

a latch cooperating with the at least one joint to releasably prevent the at least the portion of the lower frame from folding; and a spring biasing the latch into engagement with the at least one joint; and a cover located to prevent overloading of the spring.

25. A play yard as defined in claim 24 wherein the spring and the cover are mounted to the at least one joint.

26. For use with a foldable play yard having an upper frame and a lower frame, a locking joint comprising:

a first joint member defining a first opening;

a second joint member defining a second opening, the first and second joint members being adapted to be disposed in the lower frame and being joined for pivoting movement between a first position and a second position, the first and second openings being substantially aligned when the first and second joint members are in the first position;

a latch dimensioned to mate with the first and second openings to releasably secure the first and second joint members in the first position; and a strap operatively coupled to the latch for selectively withdrawing the latch from the first and second openings.

27. A locking joint as defined in claim 26 further comprising a spring biasing the latch into engagement with the first and second openings when the first and second openings are aligned.

28. A locking joint as defined in claim 27 further comprising a cover located to prevent overloading of the spring.

29. A locking joint as defined in claim 28 wherein the spring and the cover are mounted to the first joint member.

30. A locking joint as defined in claim 26 further comprising:

a floor supported by the lower frame; and a handle positioned at a substantially central area of the floor, wherein the strap is operatively coupled to the handle such that, lifting the handle pulls the strap to withdraw the latch from the first and second openings.

31. A locking joint as defined in claim 30 wherein the latch is shaped such that the latch may be withdrawn from the first and second openings when the play yard is in a partially erected condition and also when the play yard is in a fully erected condition.

32. A locking joint as defined in claim 31 wherein the latch comprises:

a tab for cooperating with the first and second openings;

a flange for cooperating with the strap; and a web joining the tab and the flange, wherein the tab and the flange are disposed in different planes.

33. A locking joint as defined in claim 32 wherein the flange and the tab are disposed in substantially parallel planes.

34. A locking joint as defined in claim 26 wherein the first joint member comprises a first flange, a second flange, and a web joining the first and second flanges, and the second joint member comprises a third flange, a fourth flange, and a web joining the third and fourth flanges.

35. A locking joint as defined in claim 34 wherein the first, second, third, and fourth flanges define bores for receiving a pivot pin which pivotably joins the first and second joint members.

36. A locking joint as defined in claim 34 further comprising a spacer positioned between at least two of the first, second, third, and fourth flanges to increase the structural rigidity of the at least one joint.

37. A locking joint as defined in claim 34 further comprising a lock protrusion located to engage one of the first and second joint members to define the first position of the first and second joint members.

38. A foldable play yard comprising:

an upper frame;

a lower frame including at least one joint to permit folding of at least a portion of the lower frame;

a floor supported by the lower frame, the at least one joint of the lower frame being displaced from a center of the floor; and a latch cooperating with the at least one joint to releasably prevent the at least the portion of the lower frame from folding;

wherein the joint further comprises a first joint member defining a first opening; and a second joint member defining a second opening, the first and second joint members being joined for pivoting movement between a first position and a second position, the first and second openings being substantially aligned when the first and second joint members are in the first position, and the first and second openings being sized to cooperate with the latch to releasably secure the first and second joint members in the first position to prevent the at least a portion of the lower frame from folding;

a spring biasing the latch into engagement with the first and second openings when the first and second openings are aligned; and a cover located to prevent overloading of the spring.

39. A foldable play yard comprising:

an upper frame;

a lower frame including at least one joint to permit folding of at least a portion of the lower frame;

a floor supported by the lower frame, the at least one joint of the lower frame being displaced from a center of the floor; and a latch cooperating with the at least one joint to releasably prevent the at least the portion of the lower frame from folding; wherein the latch comprises:

a tab;

a flange; and a web joining the tab and the flange, wherein the tab and the flange are disposed in different planes.

40. A play yard as defined in claim 39 wherein the flange and the tab are disposed in substantially parallel planes.

41. A play yard as defined in claim 40 wherein the flange is disposed above the tab.

42. A play yard as defined in claim 41 wherein the at least one joint includes a first joint member defining a first opening and a second joint member defining a second opening, and wherein the flange and one of the first and second joint members cooperate to rotate the tab out of at least one of the first and second openings in response to a force with an upward component.

43. A foldable play yard comprising:

an upper frame;

a lower frame including at least one joint to permit folding of at least a portion of the lower frame;

a floor supported by the lower frame, the at least one joint of the lower frame being displaced from a center of the floor; and a latch cooperating with the at least one joint to releasably prevent the at least the portion of the lower frame from folding;

wherein the joint further comprises a first joint member defining a first opening; and a second joint member defining a second opening, the first and second joint members being joined for pivoting movement between a first position and a second position, the first and second openings being substantially aligned when the first and second joint members are in the first position, and the first and second openings being sized to cooperate with the latch to releasably secure the first and second joint members in the first position to prevent the at least a portion of the lower frame from folding;

wherein the first joint member comprises a first flange, a second flange, and a web joining the first and second flanges, and the second joint member comprises a third flange, a fourth flange, and a web joining the third and fourth flanges.

44. A play yard as defined in claim 43 wherein the first, second, third, and fourth flanges define bores for receiving a pivot pin which pivotably joins the first and second joint members.

45. A play yard as defined in claim 43 further comprising a spacer positioned between at least two of the first, second, third, and fourth flanges to increase the structural rigidity of the at least one joint.

46. For use with a foldable play yard having an upper frame and a lower frame, a locking joint comprising:

a first joint member defining a first opening;

a second joint member defining a second opening, the first and second joint members being adapted to be disposed in the lower frame and being joined for pivoting movement between a first position and a second position, the first and second openings being substantially aligned when the first and second joint members are in the first position;

a latch dimensioned to mate with the first and second openings to releasably secure the first and second joint members in the first position;

a spring biasing the latch into engagement with the first and second openings when the first and second openings are aligned; and a cover located to prevent overloading of the spring.

47. A locking joint as defined in claim 46 wherein the spring and the cover are mounted to the first joint member.

48. For use with a foldable play yard having an upper frame and a lower frame, a locking joint comprising:

a first joint member defining a first opening;

a second joint member defining a second opening, the first and second joint members being adapted to be disposed in the lower frame and being joined for pivoting movement between a first position and a second position, the first and second openings being substantially aligned when the first and second joint members are in the first position; and a latch dimensioned to mate with the first and second openings to releasably secure the first and second joint members in the first position;

wherein the first joint member comprises a first flange, a second flange, and a web joining the first and second flanges, and the second joint member comprises a third flange, a fourth flange, and a web joining the third and fourth flanges.

49. A locking joint as defined in claim 48 wherein the first, second, third, and fourth flanges define bores for receiving a pivot pin which pivotably joins the first and second joint members.

50. A locking joint as defined in claim 48 further comprising a spacer positioned between at least two of the first, second, third, and fourth flanges to increase the structural rigidity of the at least one joint.

51. A locking joint as defined in claim 48 further comprising a lock protrusion located to engage one of the first and second joint members to define the first position of the first and second joint members.

* * * * *